US010308045B2

(12) United States Patent
Aoki

(10) Patent No.: US 10,308,045 B2
(45) Date of Patent: Jun. 4, 2019

(54) SHEET CONVEYOR AND INK-JET RECORDING APPARATUS

(71) Applicant: BROTHER KOGYO KABUSHIKI KAISHA, Nagoya-shi, Aichi-ken (JP)

(72) Inventor: Hirotaka Aoki, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/416,629

(22) Filed: Jan. 26, 2017

(65) Prior Publication Data

US 2017/0217218 A1 Aug. 3, 2017

(30) Foreign Application Priority Data

Jan. 29, 2016 (JP) ..... 2016-016741

(51) Int. Cl.

| | |
|---|---|
| ***B41J 11/00*** | (2006.01) |
| ***B65H 5/06*** | (2006.01) |
| ***B65H 3/06*** | (2006.01) |
| ***B41J 13/10*** | (2006.01) |
| ***B65H 85/00*** | (2006.01) |
| ***B65H 5/38*** | (2006.01) |

(52) U.S. Cl.

CPC ..... *B41J 11/0045* (2013.01); *B41J 13/103* (2013.01); *B65H 3/0669* (2013.01); *B65H 3/0684* (2013.01); *B65H 5/062* (2013.01); *B65H 5/38* (2013.01); *B65H 85/00* (2013.01); *B65H 2404/61* (2013.01); *B65H 2801/06* (2013.01)

(58) Field of Classification Search

CPC .... B41J 11/0045; B65H 5/062; B65H 3/0684; B65H 2801/06

See application file for complete search history.

(56) References Cited

U.S. PATENT DOCUMENTS

2006/0024118 A1* 2/2006 Niikura ..... B41J 29/02 400/691
2006/0244209 A1* 11/2006 Kubota ..... B65H 31/24 271/225
2007/0096386 A1* 5/2007 Asada ..... B41J 13/0045 271/145
2007/0200285 A1* 8/2007 Shiohara ..... B65H 3/0684 271/162
2009/0001647 A1* 1/2009 Izuchi ..... B65H 1/26 270/18

(Continued)

FOREIGN PATENT DOCUMENTS

JP 2006-035802 A 2/2006

*Primary Examiner* — Henok D Legesse

(74) *Attorney, Agent, or Firm* — Merchant & Gould P.C.

(57) ABSTRACT

A sheet conveyor, including: a shaft defining an axis that extends in a first direction; an arm pivotable about the axis; a supply roller provided on the arm and configured to supply a sheet; a first frame formed of metal and supporting the shaft; a first conveyance roller configured to covey the sheet supplied from the supply roller; and a second frame formed of metal and supporting the first conveyance roller, wherein the second frame includes (a) a contact plate portion shaped like a plate and having a contact surface that is held in contact with the first frame and (b) a wall portion extending from the contact plate portion in a direction intersecting the contact surface, and wherein the second frame is coupled at the contact plate portion thereof to the first frame.

10 Claims, 8 Drawing Sheets

(56) References Cited

U.S. PATENT DOCUMENTS

| | | | | |
|---|---|---|---|---|
| 2009/0026685 | A1* | 1/2009 | Uchino | B41J 3/60 270/18 |
| 2013/0256977 | A1* | 10/2013 | Aoki | B65H 3/0684 271/117 |
| 2013/0321548 | A1* | 12/2013 | Asada | B41J 13/10 347/104 |
| 2015/0251866 | A1* | 9/2015 | Shimizu | B65H 3/0684 271/228 |
| 2016/0089910 | A1* | 3/2016 | Iijima | B41J 3/60 347/104 |

* cited by examiner

SHEET CONVEYOR AND INK-JET RECORDING APPARATUS

CROSS REFERENCE TO RELATED APPLICATION

The present application claims priority from Japanese Patent Application No. 2016-016741, which was filed on Jan. 29, 2016, the disclosure of which is herein incorporated by reference in its entirety.

BACKGROUND

Technical Field

The present disclosure relates to a sheet conveyor configured to convey a sheet supported by a support portion or a sheet supporter and relates to an ink-jet recording apparatus equipped with the sheet conveyor.

Description of Related Art

There have been known sheet conveyors having a configuration for conveying a sheet with high accuracy. For instance, a recording apparatus (a sheet conveyor) having a recording unit and a sheet supply unit is known. The recording unit includes a conveyance roller. The sheet supply unit includes a supply roller. A sheet supplied from a supply tray by the supply roller is conveyed by the conveyance roller. The recording unit and the sheet supply unit are fixed, at opposite end portions thereof in a direction perpendicular to a conveyance direction, to a pair of side chassis. In the recording apparatus, the position of the supply roller is fixed. A pressure plate on which a sheet is placed is urged toward the supply roller, whereby the supply roller comes into contact with the surface of the sheet.

Further, a sheet conveyor having a pendulum supply roller is known. The sheet conveyor includes a supply roller supported by a pivotable arm. The supply roller is urged toward a sheet supported on a supply tray.

SUMMARY

In the sheet conveyor including the pendulum supply roller, it is preferable that parallelism between a pivot axis of the arm and a rotation axis of the conveyance roller be maintained, for instance. To this end, it is necessary that positional relationship between the two axes is kept accurate. If the positional relationship between the two axes are not accurate and the parallelism therebetween is not maintained, there may be a risk that the sheet conveyed by the supply roller and the conveyance roller may be skewed.

The present disclosure provides a sheet conveyor having a pendulum supply roller in which skewing of sheets is prevented.

In one aspect of the disclosure, a sheet conveyor includes: a shaft defining an axis that extends in a first direction; an arm pivotable about the axis; a supply roller provided on the arm and configured to supply a sheet; a first frame formed of metal and supporting the shaft; a first conveyance roller configured to covey the sheet supplied from the supply roller; and a second frame formed of metal and supporting the first conveyance roller, wherein the second frame includes (a) a contact plate portion shaped like a plate and having a contact surface that is held in contact with the first frame and (b) a wall portion extending from the contact plate portion in a direction intersecting the contact surface, and wherein the second frame is coupled at the contact plate portion thereof to the first frame.

In another aspect of the disclosure, a sheet conveyor includes: a shaft defining an axis that extends in a first direction; an arm pivotable about the axis; a supply roller provided on the arm and configured to supply a sheet; a first frame formed of metal and supporting the shaft; a first conveyance roller configured to covey the sheet supplied from the supply roller; and a second frame formed of metal and supporting the first conveyance roller, wherein the second frame includes a contact plate having a contact surface that is held in contact with the first frame, the second frame being bent at the contact plate in a direction intersecting the contact surface, and wherein the second frame is coupled at the contact plate thereof to the first frame.

In still another aspect of the disclosure, an ink-jet recording apparatus includes: a recording head; a carriage on which the recording head is mounted; a guide rail holding the carriage such that the carriage reciprocates along the first direction; and the sheet conveyor constructed as described above, wherein the guide rail is supported by the second frame.

BRIEF DESCRIPTION OF THE DRAWINGS

The objects, features, advantages, and technical and industrial significance of the present disclosure will be better understood by reading the following detailed description of an embodiment, when considered in connection with the accompanying drawings, in which.

DETAILED DESCRIPTION OF THE EMBODIMENT

Figure 1:
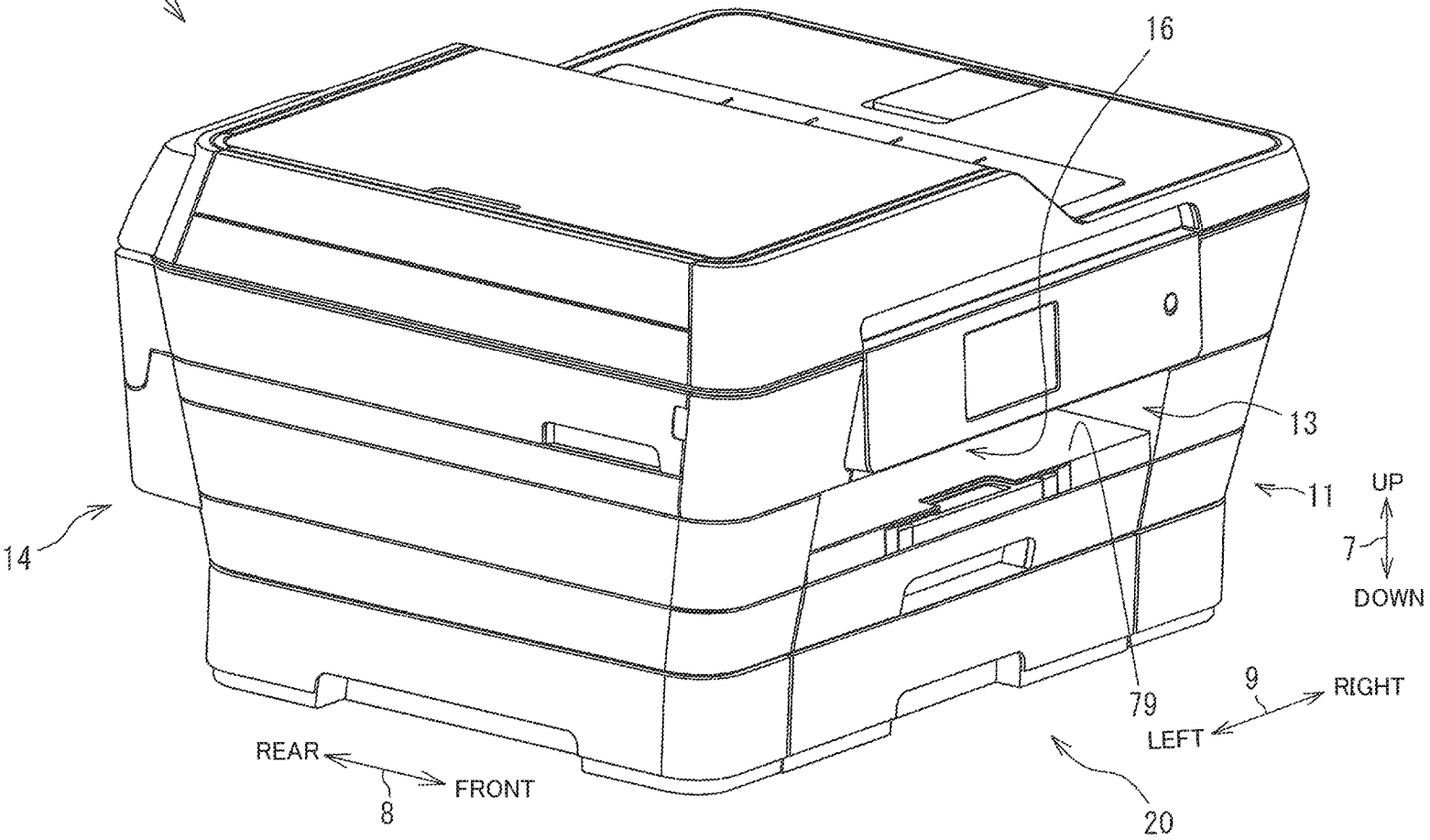
FIG. 1 is a perspective view of an MFP.

Referring to the drawings, there will be described one embodiment. It is to be understood that the following embodiment is described only by way of example, and the disclosure may be otherwise embodied without departing from the scope of the disclosure. A multi-functional peripheral (MFP) 10 of the present embodiment is used in a state shown in FIG. 1. In the present embodiment, an up-down direction 7 is defined with respect to this state. Further, a front-rear direction 8 (as one example of a second direction) is defined by regarding a side of the MFP 10 in which an opening 13 is formed as a front side, and a right-left direction 9 (as one example of a first direction) is defined in a state in which the MFP 10 is viewed from the font side.

Figure 2:
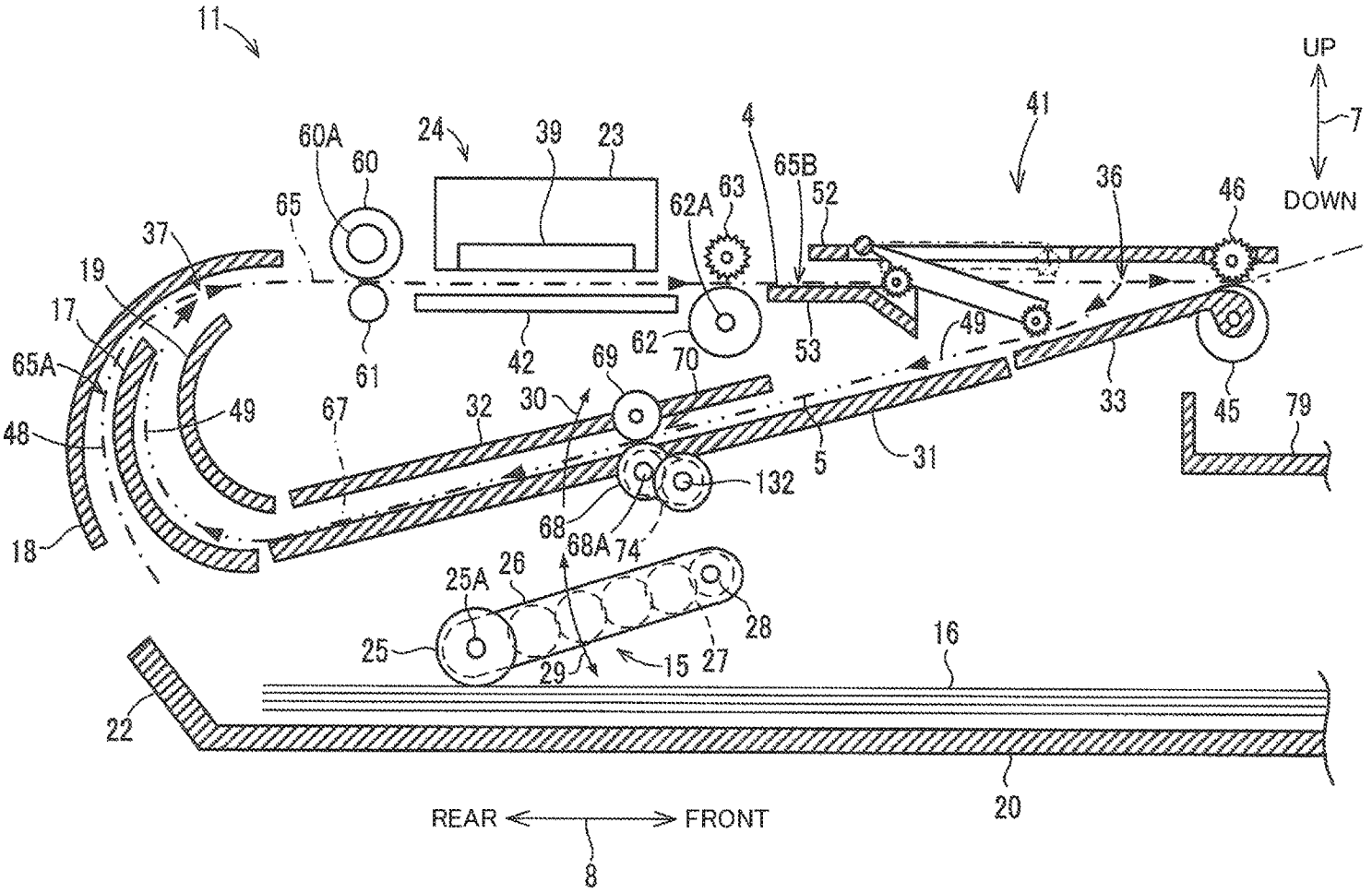
FIG. 2 is an elevational view in vertical cross section schematically showing an internal structure of the MFP.

As shown in FIG. 1, the MFP 10 (as one example of an ink-jet recording apparatus and a sheet conveyor) has a housing 14 shaped like a generally rectangular parallelepiped. A printer 11 of an ink-jet recording type is provided in a lower portion of the housing 14. The MFP 10 has various functions such as a facsimile function and a printing function. One example of the printing function of the MFP 10 is a double-sided image recording function for recording images on both sides of a recording sheet 16 (FIG. 2). It is noted that functions of the MFP 10 other than the printing function are optional. The opening 13 is formed on the front side of the housing 14. A supply tray 20, on which the recording sheets 16 of various sizes can be stacked, is insertable and removable through the opening 13 in the front-rear direction 8. In other words, the supply tray 20 is mountable on and removable from the MFP 10.

Structure of Printer 11

As shown in FIG. 2, the printer 11 includes: a sheet supplying portion 15 configured to supply one of the recording sheets 16 stacked on the supply tray 20; a recording portion 24 of an ink-jet recording type disposed above the supply tray 20 and configured to record an image on the recording sheet 16 supplied by the sheet supplying portion 15 by ejecting ink droplets onto the recording sheet 16; and a path switcher 41. In the present embodiment, the recording portion 24 is of an ink-jet recording type. The recording portion 24 may be of other types such as an electrophotographic type.

Sheet Supplying Portion 15

Figure 7A:
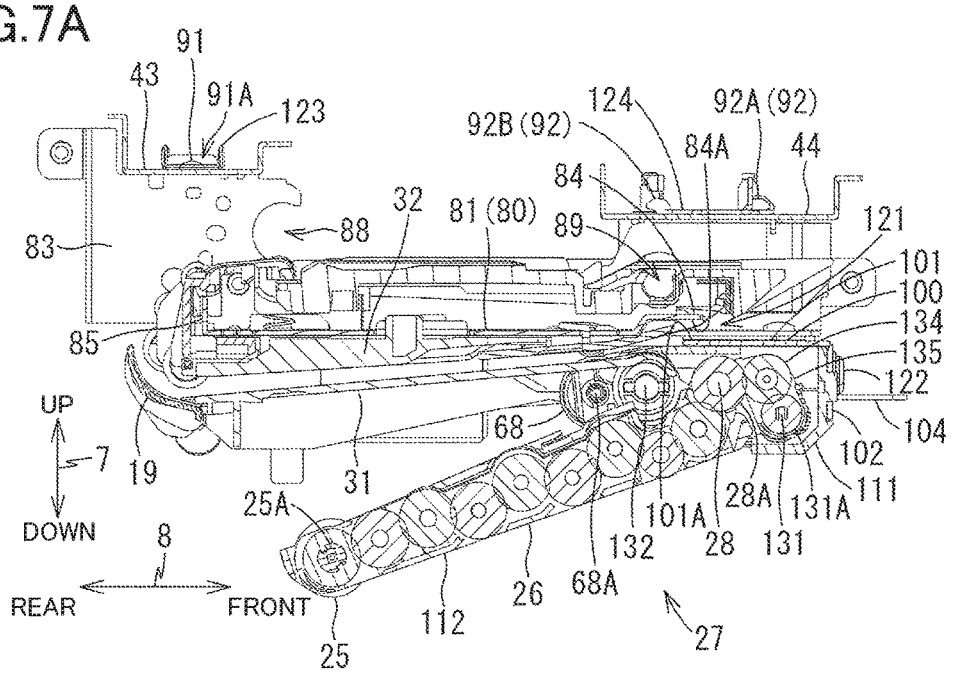
FIG. 7A is a cross-sectional view taken along line A-A in FIG. 6
Figure 7B:
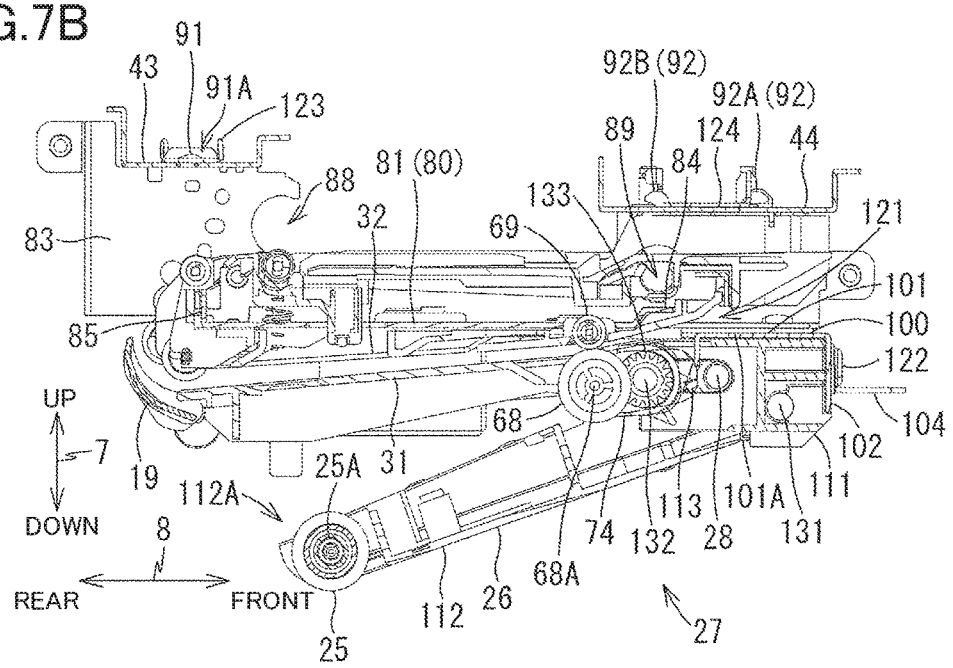
FIG. 7B is a cross-sectional view taken along line B-B in FIG. 6.
Figure 8:
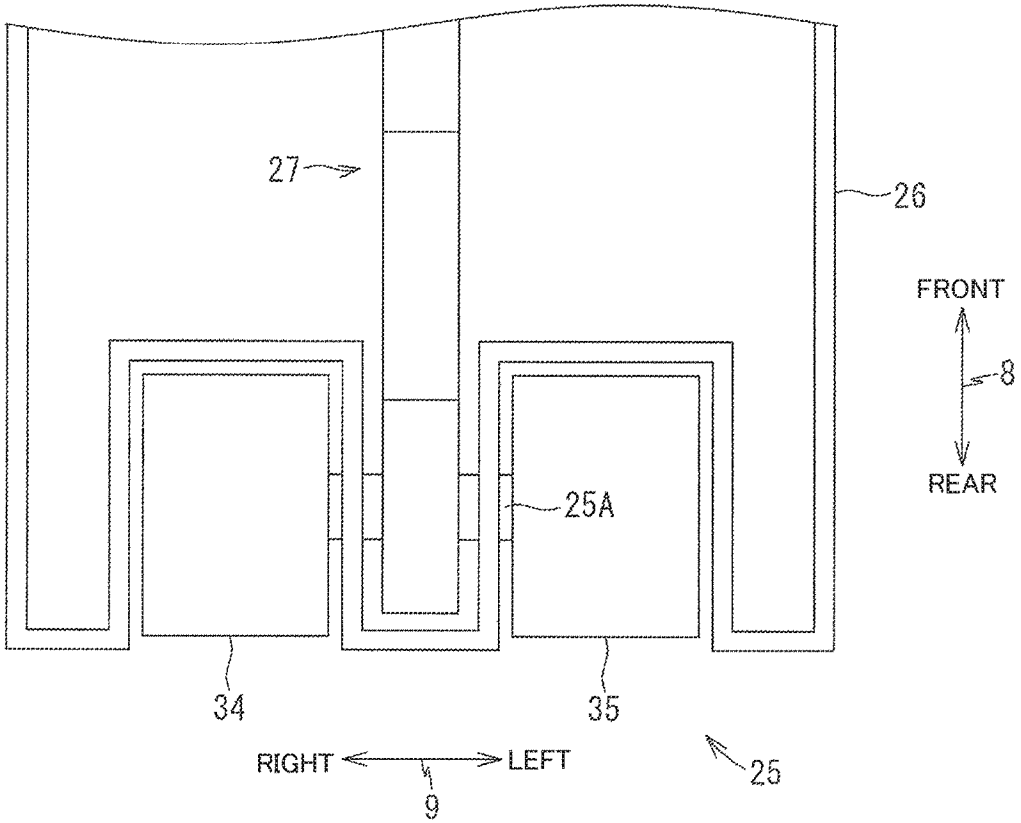
FIG. 8 is a plan view schematically showing a supply roller.

As shown in FIG. 2, the sheet supplying portion 15 is provided above the supply tray 20 and below the recording portion 24. The sheet supplying portion 15 includes a supply roller 25, a supply arm 26 (as one example of an arm), and a drive-force transmitting mechanism 27. The supply roller 25 is rotatably supported at a distal end portion of the supply arm 26. The supply roller 25 is constituted by two rollers 34, 35 spaced apart from each other in the right-left direction 9 (FIG. 8). The supply arm 26 pivots, in directions indicated by an arrow 29 in FIG. 2, about a pivot shaft 28 (as one example of a shaft) provided at a proximal end portion of the supply arm 26 and defining an axis of a pivotal movement of the supply arm 26. This axis extends in the right-left direction 9, namely, a direction perpendicular to the sheet plane of FIG. 2. This construction allows the supply roller 25 to be moved toward and away from the supply tray 20. In other words, the supply roller 25 can be brought into contact with an uppermost one of the recording sheets 16 stacked on the supply tray 20. The supply roller 25 is rotated by a drive force generated by a supply motor (not shown) and transmitted by the drive-force transmitting mechanism 27 constituted by a plurality of gears (FIG. 7) meshing with one another. In a state in which the supply roller 25 is in contact with the uppermost one of the recording sheets 16 stacked on the supply tray 20, the supply roller 25 separates the uppermost sheet 16 from other sheets 16, so as to supply the separated sheet 16 to a first curved path 65A. The supply arm 26 will be later described in detail.

Conveyance Path 65

As shown in FIG. 2, the conveyance path 65 (as one example of a first conveyance path) is formed in the printer 11. The conveyance path 65 extends from a rear end of the supply tray 20 to a discharge tray 79 via the recording portion 24. The conveyance path 65 has: the first curved path 65A formed between the rear end of the supply tray 20 and the recording portion 24; and a discharge path 65B formed between the recording portion 24 and the discharge tray 79.

The first curved path 65A is a curved path extending from near an upper end of an inclined sheet separator plate 22 provided on the supply tray 20 to the recording portion 24. The first curved path 65A has a generally arc shape whose center of curvature is located on an inner side of the printer 11. The recording sheet 16 supplied from the supply tray 20 is guided just under the recording portion 24 after having made a U-turn along the first curved path 65A in a first conveyance direction 48, namely, in a direction indicated by the long dashed short dashed line with arrows in FIG. 2. The first curved path 65A is defined by an outer guide member 18 and an intermediate guide member 17 which are opposed to each other with a predetermined distance interposed therebetween. The outer guide member 18, the intermediate guide member 17, and guide members 19, 31, 32, 33, 52, 53, which will be later described, extend in the direction perpendicular to the sheet plane of FIG. 2, i.e., the right-left direction 9 in FIG. 1.

The discharge path 65B is a straight path extending from just under the recording portion 24 to the discharge tray 79. The recording sheet 16 is guided by the discharge path 65B in the first conveyance direction 48. In a region in which the recording portion 24 is disposed, the discharge path 65B is defined by the recording portion 24 and a platen 42 which are opposed to each other with a predetermined distance interposed therebetween. In a region in which the recording portion 24 is not disposed, the discharge path 65B is defined by an upper guide member 52 and a lower guide member 53 which are opposed to each other with a predetermined distance interposed therebetween.

A branch position 36 is located downstream of the recording portion 24 in the first conveyance direction 48. In double-sided image recording, a moving direction of the recording sheet 16 conveyed along the discharge path 65B is reversed on the downstream side of the branch position 36, and then the recording sheet 16 is conveyed toward a switchback conveyance path 67 which will be explained.

Recording Portion 24

As shown in FIG. 2, the recording portion 24 is disposed above the supply tray 20. The recording portion 24 reciprocates in the right-left direction 9, namely, in the direction perpendicular to the sheet plane of FIG. 2. The platen 42 for horizontally holding the recording sheet 16 is provided below the recording portion 24. The recording portion 24 is disposed so as to be opposed to the platen 42 in the up-down direction 7. The recording portion 24 includes a carriage 23 and a recording head 39.

Figure 6:
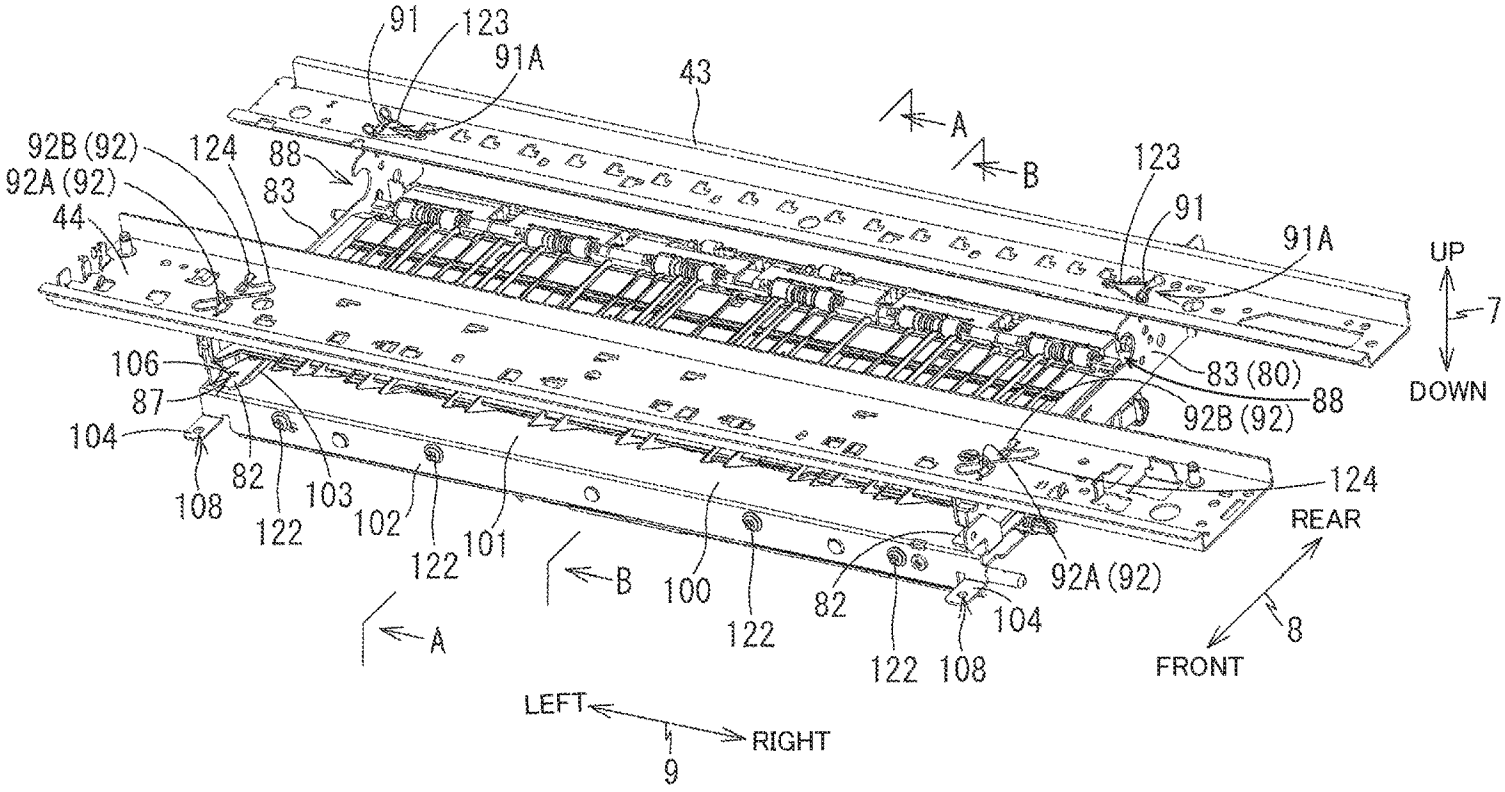
FIG. 6 is a perspective view showing a state in which a mechanism for conveying a sheet is attached to the guide rails, the frame, and the supply frame.

The carriage 23 is supported by guide rails 43, 44 (FIG. 6) spaced apart from each other in the front-rear direction 8 and extending in the right-left direction 9. As shown in FIG. 6, the guide rails 43, 44 are attached to a frame 80 (as one example of a second frame). The carriage 23 is coupled to a known belt drive mechanism (not shown) provided on the guide rail 44. The guide rails 43, 44 will be described later.

As shown in FIG. 2, the recording head 39 is mounted on the carriage 23. A plurality of nozzles (not shown) are formed in a lower surface of the recording head 39. The recording head 39 ejects, from the nozzles, ink supplied from an ink cartridge (not shown) to the recording sheet 16 conveyed on the platen 42 during the reciprocating movement of the carriage 23 in the right-left direction 9. Thus, an image is recorded on the recording sheet 16 conveyed through the conveyance path 65.

Conveyance Roller 60, Discharge Roller 62, and Bidirectional Conveyance Roller 45

As shown in FIG. 2, a conveyance roller 60 (as one example of a first conveyance roller) and a pinch roller 61 are provided between: downstream ends of the outer guide member 18 and the intermediate guide member 17 in the first conveyance direction 48; and the recording portion 24. A rotation shaft 60A of the conveyance roller 60 is rotatably supported by the frame 80. The pinch roller 61 is disposed under the conveyance roller 60 and is held in pressing contact with a roller surface of the conveyance roller 60 by an elastic member such as a spring (not shown). The conveyance roller 60 and the pinch roller 61 nip the recording sheet 16 conveyed through the first curved path 65A and convey the recording sheet 16 onto the platen 42.

A discharge roller 62 and a spur 63 are provided between: the recording portion 24; and the upper guide member 52 and the lower guide member 53. The spur 63 is disposed over the discharge roller 62 and is held in pressing contact with a roller surface of the discharge roller 62 by an elastic member such as a spring (not shown). The discharge roller 62 and the spur 63 nip the recording sheet 16 on which an image has been recorded by the recording portion 24 and convey the image-recorded sheet 16 to a downstream side in the first conveyance direction 48.

The conveyance roller 60 and the discharge roller 62 are rotated by a rotational drive force transmitted from a conveyance motor. The conveyance roller 60 and the discharge roller 62 rotate forwardly and reversely in accordance with rotation of the conveyance motor. The forward rotation of the conveyance roller 60 and the discharge roller 62 causes the recording sheet 16 to be conveyed in the first conveyance direction 48.

A bidirectional conveyance roller 45 and a spur 46 are provided downstream of the branch position 36 in the first conveyance direction 48. The spur 46 is urged downward in the up-down direction 7 by an elastic member such as a spring and is held in pressing contact with a roller surface of the bidirectional conveyance roller 45.

The bidirectional conveyance roller 45 is rotated forwardly by a forward drive force transmitted from the conveyance motor and is rotated reversely by a reverse drive force transmitted from the conveyance motor. In single-sided recording, for instance, the bidirectional conveyance roller 45 is rotated forwardly, so that the recording sheet 16 nipped by the bidirectional conveyance roller 45 and the spur 46 is conveyed downstream and is discharged onto the discharge tray 79. In double-sided recording, for instance, the rotational direction of the bidirectional conveyance roller 45 is switched from the forward direction to the reverse direction in a state in which the bidirectional conveyance roller 45 and the spur 46 nip a trailing end of the recording sheet 16. As a result, the recording sheet 16 is conveyed in a direction opposite to the first conveyance direction 48 and is conveyed toward the switchback conveyance path 67 by the path switcher 41.

Switchback Conveyance Path 67

As shown in FIG. 2, the switchback conveyance path 67 (as one example of a second conveyance path) is connected to the conveyance path 65 at the branch position 36 of the discharge path 65B and at a merge position 37 of the first curved path 65A located upstream of the recording portion 24 in the first conveyance direction 48. The recording sheet 16 is conveyed through the switchback conveyance path 67 in a second conveyance direction 49. The second conveyance direction 49 is a direction in which the recording sheet 16 is conveyed through the switchback conveyance path 67 from the branch position 36 toward the merge position 37, as indicated by the long dashed double-short dashed line with arrows in FIG. 2.

The switchback conveyance path 67 includes: a straight portion that extends from the branch position 36 along the second conveyance direction 49 rearward and downward; and a curved portion that is curved upward. An upper part of the straight portion and an inner part of the curved portion of the switchback conveyance path 67 are defined by a second guide member 32 (FIG. 7) and the inner guide member 19 (FIG. 7) while a lower part of the straight portion and an outer part of the curved portion of the switchback conveyance path 67 are defined by a first guide member 31 (FIG. 7), a third guide member 33, and the intermediate guide member 17.

Conveyance Roller 68

A conveyance roller 68 (as one example of a second conveyance roller) and a driven roller 69 are provided in the switchback conveyance path 67. The driven roller 69 is disposed below the recording portion 24 and over the conveyance roller 68. As shown in FIG. 7B, the conveyance roller 68 is supported by a rear end portion of a conveyance arm 74 which is supported by a stationary portion 111 of the supply arm 26. The driven roller 69 is rotatably supported by the second guide member 32.

The conveyance roller 68 is disposed under the driven roller 69. The switchback conveyance path 67 is interposed between the conveyance roller 68 and the driven roller 69 in the up-down direction 7. The conveyance roller 68 is held in pressing contact with a roller surface of the driven roller 69 by a coil spring (not shown).

The conveyance roller 68 is rotated forwardly by a forward drive force transmitted from the supply motor (not shown). A conveyance roller pair 70 constituted by the conveyance roller 68 and the driven roller 69 is configured such that, when the supply motor forwardly rotates, the conveyance roller 68 and the driven roller 69 nip the recording sheet 16 conveyed through the switchback conveyance path 67 and convey the recording sheet 16 in the second conveyance direction 49.

Lower Cover 12

Figure 5:
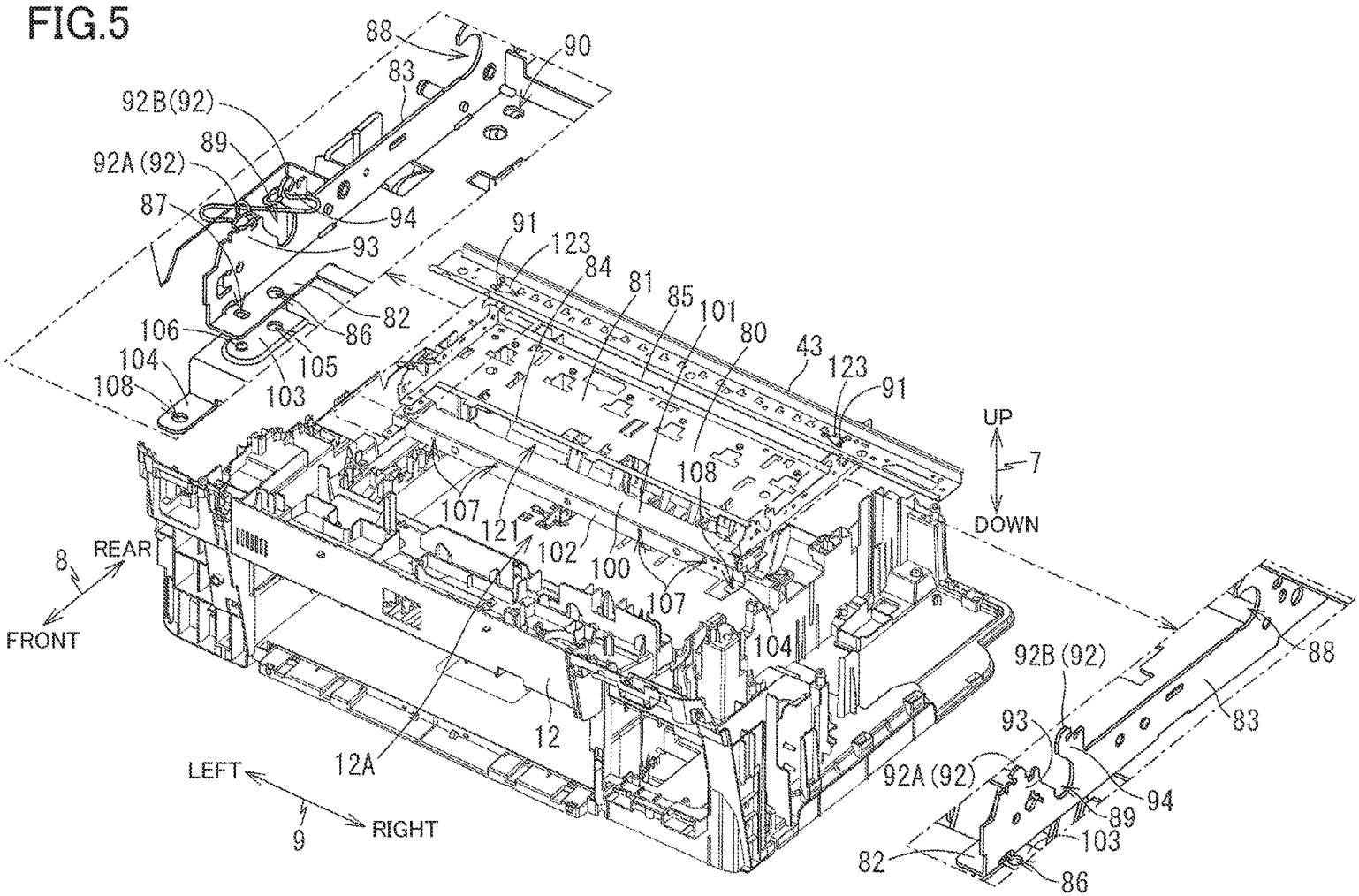
FIG. 5 is a perspective view showing the guide rail, the frame, the supply frame, and the lower cover.

As shown in FIG. 5, the MFP 10 has a box-like lower cover 12. The lower cover 12 is a part of the housing 14 and forms a bottom surface of the MFP 10, etc. The lower cover 12 defines therein a space 12A opening upward and located at a central portion of the lower cover 12 in the front-rear direction 8 and the right-left direction 9. The supply tray 20 described above is disposed in the space 12A. The lower cover 12 is formed of resin.

Guide Rails 43, 44

As shown in FIG. 6, each of the guide rails 43, 44 extends along a plane defined by the front-rear direction 8 and the right-left direction 9. Each of the guide rails 43, 44 is a flat plate having a generally rectangular shape that is long in the right-left direction 9. The guide rail 44 is located forward of and at a height position lower than the guide rail 43 (FIG. 7). Each of the guide rails 43, 44 is formed by sheet metal working of a metal plate. Each of the guide rails 43, 44 has through-holes (not shown) penetrating therethrough in the up-down direction 7 and formed at respective opposite end portions in the right-left direction 9. Positions of the through-holes of the guide rail 43 correspond to positions of first engaging portions 91 of the frame 80 which will be explained. Positions of the through-holes of the guide rail 44 correspond to positions of second engaging portions 92 of the frame 80 which will be explained.

As shown in FIG. 6, each of the guide rails 43, 44 is bent upward at its opposite ends in the front-rear direction 8. Thus, each guide rail 43, 44 is prevented from being deformed such that its central portion in the right-left direction 9 is displaced in the up-down direction 7 or the front-rear direction 8 with respect to its opposite end portions in the right-left direction 9.

Frame 80

Figure 3:
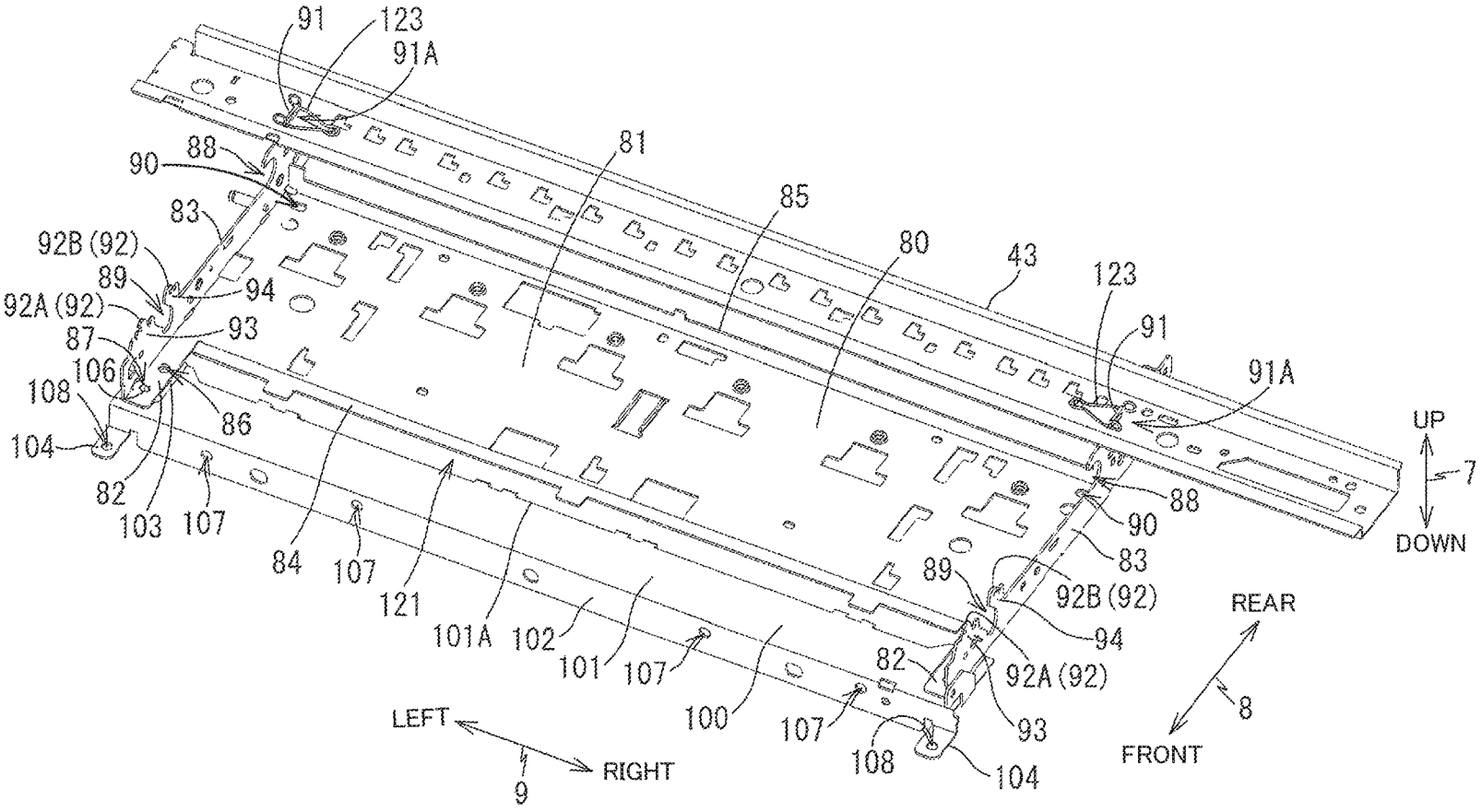
FIG. 3 is a perspective view showing a state in which a guide rail, a frame, and a supply frame are assembled.

As shown in FIG. 3, the MFP 10 includes the frame 80. The frame 80 is located below the guide rails 43, 44 (FIG. 7). As shown in FIG. 3, the frame 80 is a flat rectangular plate extending along the plane defined by the front-rear direction 8 and the right-left direction 9. The frame 80 is produced by sheet metal working of a metal plate.

As shown in FIG. 3, the frame 80 includes a flat plate portion 81, right and left contact plate portions 82, right and left wall portions 83, a front extending portion 84, and a vertical plate portion 85.

The flat plate portion 81 is flat rectangular plate disposed along the plane defined by the front-rear direction 8 and the right-left direction 9. The flat plate portion 81 has a pair of right and left through-holes 90 penetrating therethrough in the up-down direction 7. The through-holes 90 are formed at a rear end portion of the flat plate portion 81 so as to be located respectively at opposite ends in the right-left direction 9. Each through-hole 90 is longer in the right-left direction 9. Screws are inserted in the through-holes 90 for screwing the frame 80 to the lower cover 12.

The contact plate portions 82 extend forward from opposite ends in the right-left direction 9 of a front end of the flat plate portion 81. That is, two contact plate portions 82 are provided so as to be spaced apart from each other in the right-left direction 9. Each contact plate portion 82 is a flat rectangular plate extending along the plane defined by the front-rear direction 8 and the right-left direction 9. A lower surface 82A (FIG. 4C) of each contact plate portion 82 is a flat surface extending along the plane defined by the front-rear direction 8 and the right-left direction 9. The lower surface 82A of the contact plate portion 82 is one example of a contact surface. Positions of the lower surfaces 82A of the contact plate portions 82 correspond to positions of protruding portions 103 of a supply frame 100 (as one example of a first frame) which will be explained.

Figure 4A:
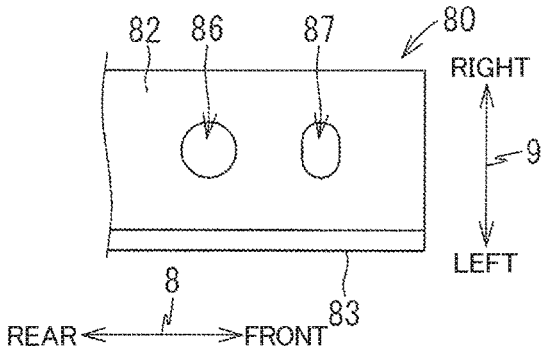
FIG. 4A is a plan view schematically showing a contact plate portion of the frame.

As shown in FIG. 4A, each contact plate portion 82 has two through-holes 86, 87 which penetrate therethrough in the up-down direction 7 and which are spaced apart from each other in the front-rear direction 8. The through-hole 86 is a circular through-hole and is used for fixing the supply frame 100 and the frame 80 to the lower cover 12. The through-hole 87 is located forward of the through-hole 86. The through-hole 87 is longer in the right-left direction 9. A protrusion 106 of the supply frame 100 is inserted into the through-hole 87 from below.

As shown in FIG. 3, each wall portion 83 extends upward from a corresponding one of opposite ends of the flat plate portion 81 in the right-left direction 9 and a corresponding one of opposite ends of each contact plate portion 82 in the right-left direction 9. The wall portion 83 is a flat rectangular plate extending in the right-left direction 9. The wall portion 83 extends from a front end of the contact plate portion 82 to beyond a rear end of the flat plate portion 81.

A pair of right and left rotation-shaft support portions 88 and a pair of right and left rotation-shaft support portions 89 are formed in the wall portions 83. The rotation-shaft support portions 88 are located at a position which is rearward of a central part of each wall portion 83 in the front-rear direction 8 and which corresponds to the rear end of the flat plate portion 81. An upper end of a rear end portion of the wall portion 83 is located at a height level higher than an upper end of a front end portion thereof, so that a stepped portion is formed therebetween. The rotation-shaft support portion 88 is a recess which is formed at the stepped portion so as to be recessed backward. In the rotation-shaft support portions 88, there is received a bearing which rotatably supports the rotation shaft 60A (FIG. 2) of the conveyance roller 60. The rotation shaft 60A of the conveyance roller 60 is supported by the bearing.

As shown in FIG. 3, the rotation-shaft support portions 89 are located at the front end portion of the wall portions 83. Each wall portion 83 has, at its front end portion, two protruding portions 93, 94 spaced apart from each other in the front-rear direction 8. The rotation-shaft support portion 89 is a recess which is formed between the protruding portions 93, 94 so as to be recessed downward and rearward from the upper end of the wall portion 83. In the rotation-shaft support portion 89, there is received a bearing which rotatably supports a rotation shaft 62A (FIG. 2) of the discharge roller 62. The rotation shaft 62A of the discharge roller 62 is supported by the bearing.

Each of the two wall portions 83 includes the first engaging portion 91 and the second engaging portion 92.

As shown in FIG. 3, the first engaging portion 91 protrudes upward from an upper end of each wall portion 83 on the back side of the rotation-shaft support portion 88 and the vertical plate portion 85. As shown in FIGS. 7A and 7B, the first engaging portion 91 is a flat rectangular plate extending along a plane defined by the up-down direction 7 and the front-rear direction 8. The first engaging portion 91 has a through-hole 91A formed therethrough in the right-left direction. The through-hole 91A is longer in the front-rear direction 8. The positions of the first engaging portions 91 correspond to the positions of the through-holes (not shown) of the guide rail 43. The guide rail 43 is positioned with respect to the front-rear direction 8 and the right-left direction 9 by engagement of the guide rail 43 and the first engaging portions 91. Further, the guide rail 43 is positioned with respect to the up-down direction 7 by contact of the lower surface of the guide rail 43 and the upper ends of the wall portions 83.

As shown in FIG. 5, the second engaging portion 92 is formed at both of the protruding portion 93 and the protruding portion 94. A second engaging portion 92A formed at the protruding portion 93 has a hook-like shape that protrudes upward from an upper end of the protruding portion 93 and is bent forward. A second engaging portion 92B of the protruding portion 94 has a hook-like shape that protrudes upward from an upper end of the protruding portion 94 and is bent rearward. The positions of the second engaging portions 92 correspond to the positions of the through-holes (not shown) of the guide rail 44. The guide rail 44 is positioned with respect to the front-rear direction 8 and the right-left direction 9 by engagement of the guide rail 44 and the second engaging portions 92. Further, the guide rail 44 is positioned with respect to the up-down direction 7 by contact of the lower surface of the guide rail 44 and the upper ends of the wall portions 83.

As shown in FIG. 3, the front extending portion 84 is located on an inner side of the contact plate portions 82 in the right-left direction 9. The front extending portion 84 extends upward from a front end of the flat plate portion 81 so as to have an L-like bent shape (FIG. 7). The front extending portion 84 defines an upper end of a part of the switchback conveyance path 67. Owing to the front extending portion 84, the frame 80 is prevented from being deformed such that its central portion in the right-left direction 9 is displaced in the up-down direction 7 or the front-rear direction 8 with respect to its opposite end portions in the right-left direction 9.

As shown in FIG. 3, the vertical plate portion 85 is located on an inner side of the wall portions 83 in the right-left direction 9. The vertical plate portion 85 extends upward from the rear end of the flat plate portion 81 and extends in the right-left direction 9. Owing to the vertical plate portion 85, the frame 80 is prevented from being deformed such that its central portion in the right-left direction 9 is displaced in the up-down direction 7 or the front-rear direction 8 with respect to its opposite end portions in the right-left direction 9.

Supply Frame 100

As shown in FIG. 3, the supply frame 100 is located forward of the frame 80 and below the guide rail 44 (FIG. 7). As shown in FIG. 3, the supply frame 100 is a flat rectangular plate extending along the plane defined by the front-rear direction 8 and the right-left direction 9. The supply frame 100 is produced by sheet metal working of a metal plate.

The supply frame 100 includes a horizontal plate portion 101, a vertical plate portion 102, and projecting portions 104.

The horizontal plate portion 101 is a flat rectangular plate extending along the plane defined by the front-rear direction 8 and the right-left direction 9. As shown in FIG. 7, an opening 121 is formed at a position which is between the horizontal plate portion 101 and the front extending portion 84 of the frame 80 and which is between the two contact plate portions 82 (FIG. 3). The opening 121 is defined by an upper surface 101A of a rear end portion of the horizontal plate portion 101 and a lower surface 84A of the front extending portion 84. The recording sheet 16 guided by the switchback conveyance path 67 passes through the opening 121.

Figure 4B:
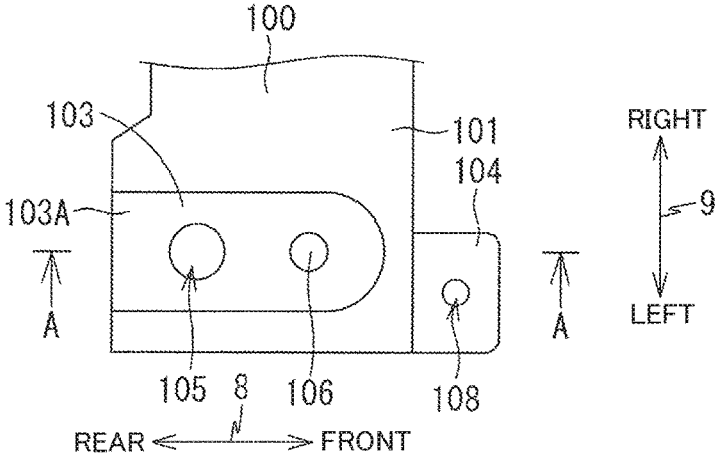
FIG. 4B is a plan view schematically showing a protruding portion of the supply frame.
Figure 4C:
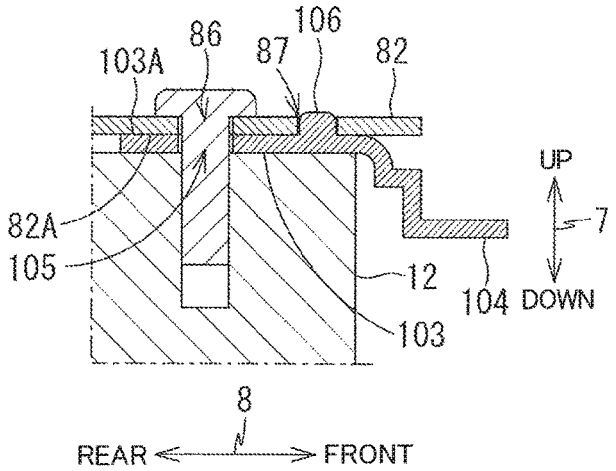
FIG. 4C is a cross-sectional view taken along line A-A in FIG. 4B showing a state in which a lower surface of the contact plate portion and an upper surface of the protruding portion which are held in contact with each other are screwed to a lower cover.

As shown in FIG. 5, the horizontal plate portion 101 has protruding portions 103 at respective opposite ends thereof in the right-left direction 9. Each protruding portion 103 has a generally rectangular shape. As shown in FIG. 4C, the protruding portion 103 protrudes upward so as to have a height higher than other portion of the horizontal plate portion 101. As shown in FIG. 4B, the protruding portion 103 includes a circular through-hole 105 penetrating therethrough in the up-down direction 7 and a circular protrusion 106 located forward of the through-hole 105 and protruding upward. As shown in FIG. 4C, an upper surface 103A of the protruding portion 103 is a flat surface extending along the plane defined by the front-rear direction 8 and the right-left direction 9. The upper surfaces 103A of the protruding portions 103 are held in contact with the lower surfaces 82A of the contact plate portions 82 of the frame 80, whereby the supply frame 100 is positioned with respect to the frame 80 in the up-down direction 7. In a state in which the protrusions 106 are inserted in the through-holes 87 of the contact plate portions 82, the frame 80 and the supply frame 100 are screwed to the lower cover 12 by screws inserted into the through-holes 105 of the protruding portions 103 of the supply frame 100 and the through-holes 86 of the contact plate portions 82 of the frame 80. Thus, the supply frame 100 is positioned with respect to the frame 80 in the front-rear direction 8 and the right-left direction 9. In the present embodiment, the through-hole 87 has a larger dimension in the right-left direction 9 than in the front-rear direction 8 for allowing tolerances of the frame 80 and the supply frame 100 in the right-left direction 9 and for holding the shafts of the rollers supported by the frame 80 and the supply frame 100 so as to be parallel to each other.

As shown in FIG. 3, the vertical plate portion 102 extends in a downward direction (as one example of a direction perpendicular to the first direction), from an entire region at a front end portion of the horizontal plate portion 101 in the right-left direction 9. Owing to the vertical plate portion 102, the supply frame 100 is prevented from being deformed such that its central portion in the right-left direction 9 is displaced in the up-down direction 7 with respect to its opposite end portions in the right-left direction 9.

A plurality of through-holes 107 are formed in the vertical plate portion 102 in a region thereof located inward of the protruding portions 103 in the right-left direction 9. The through-holes 107 are formed through the vertical plate portion 102 in the front-rear direction 8 and are spaced apart from each other in the right-left direction 9. The supply arm 26 is screwed to the supply frame 100 by screws inserted into the through-holes 107.

The pair of projecting portions 104 are provided at opposite end portions of the vertical plate portion 102 in the right-left direction 9, so as to be located forward of the corresponding protruding portions 103. Each projecting portion 104 projects forward from the vertical plate portion 102. Each projecting portion 104 is a flat rectangular plate extending along the plane defined by the front-rear direction 8 and the right-left direction 9. Each projecting portion 104 has a through-hole 108 formed therethrough in the up-down direction 7 at a central portion thereof in the front-rear direction 8 and the right-left direction 9. The supply frame 100 is screwed to the lower cover 12 by screws inserted in the through-holes 108.

Supply Arm 26

As shown in FIG. 7, the supply arm 26 includes a stationary portion 111 and a pivotable portion 112.

The stationary portion 111 has a rectangular parallelepiped shape that is long in the right-left direction 9. The stationary portion 111 has an inner space for supporting the pivot shaft 28. The pivotable portion 112 extends from the stationary portion 111 rearward and downward and has a suitable dimension in the right-left direction 9. The pivotable portion 112 is shaped like a box opening upward. As shown in FIG. 7, a front end portion of the stationary portion 111 is in contact with the vertical plate portion 102 from the rear side in the region of the supply frame 100 located inward of the protruding portions 103 in the right-left direction 9 (FIG. 3). In this state, the stationary portion 111 is fixed to the supply frame 100 by screws 122 inserted in the through-holes 107 of the vertical plate portion 102 of the supply frame 100.

As shown in FIG. 7B, the stationary portion 111 has a shaft support portion 113. The shaft support portion 113 is located at the front end portion of the stationary portion 111. The shaft support portion 113 pivotally supports: the pivot shaft 28 that pivotally supports a front end 112A of the pivotable portion 112; and a conveyance drive shaft 132 that pivotally supports the conveyance arm 74. With this construction, the pivotable portion 112 and the conveyance arm 74 are pivotally supported by the stationary portion 111.

The MFP 10 includes a supply drive shaft 131 and the conveyance drive shaft 132.

As shown in FIG. 7B, the supply drive shaft 131 is located at a front end portion of the supply arm 26. The supply drive shaft 131 extends in the right-left direction 9, namely, in the direction perpendicular to the sheet plane of FIG. 7B. The supply drive shaft 131 is supported by the stationary portion 111. The supply drive shaft 131 is rotated by a drive force generated by the supply motor (not shown). A pendulum gear 134 is in mesh with a gear 131A configured to rotate with the supply drive shaft 131. The pendulum gear 134 is supported by an arm 135 which is coaxial with the gear 131A. Depending upon the rotational direction of the supply drive shaft 131, the pendulum gear 134 is selectively placed in a meshed state in which the pendulum gear 134 is in mesh with a gear 28A of the drive-force transmitting mechanism 27 and a non-meshed state in which the pendulum gear 134 is spaced apart from the gear 28A. The drive-force transmitting mechanism 27 is constituted by a gear train including the gear 28A and other gears. A drive force is transmitted from the gear 28A to the supply roller 25 by the drive-force transmitting mechanism 27, so that rotation of the supply drive shaft 131 is transmitted to the supply roller 25. Consequently, rotation of the supply motor in one of opposite directions causes the supply roller 25 to be rotated while rotation of the supply motor in the other of the opposite directions does not cause the supply roller 25 to be rotated.

As shown in FIG. 7B, the stationary portion 111 supports the conveyance arm 74. The conveyance drive shaft 132 defines a pivot axis of the conveyance arm 74. The conveyance drive shaft 132 extends in the right-left direction 9, namely, in the direction perpendicular to the sheet plane of FIG. 7B. The conveyance drive shaft 132 is rotated by the drive force generated by the supply motor (not shown). The rotation of the conveyance drive shaft 132 is transmitted to the conveyance roller 68 by a gear 133 attached to the conveyance drive shaft 132. Thus, the conveyance roller 68 is rotated by the drive force generated by the supply motor.

Assembling of Frame 80 and Supply Frame 100

As shown in FIG. 6, the first engaging portions 91 of the frame 80 are inserted into the through-holes (not shown) of the guide rail 43 from below, and pins 123 are fitted into the through-holes 91A of the first engaging portions 91. Thus, the guide rail 43 is engaged with the frame 80.

The second engaging portions 92 of the frame 80 are inserted into the through-holes (not shown) of the guide rail 44 from below, and the hook of the front-side second engaging portion 92A and the hook of the rear-side second engaging portion 92B are engaged with the through-holes of the guide rail 44. A pin 124 is attached so as to extend over the second engaging portions 92A, 92B. Thus, the guide rail 44 is engaged with the frame 80.

As shown in FIG. 7B, the rotation shaft 60A (FIG. 2) of the conveyance roller 60 is received in the rotation-shaft support portion 88 of the frame 80.

The stationary portion 111 of the supply arm 26 is screwed to the supply frame 100 by the screws 122 inserted in the through-holes 107 of the supply frame 100, whereby the supply arm 26 is attached to the supply frame 100.

As shown in FIG. 4C, in a state in which the through-hole 86 formed in each contact plate portion 82 of the frame 80 and the through-hole 105 formed in each protruding portion 103 of the supply frame 100 are aligned with each other and the protrusion 106 of each protruding portion 103 is inserted from below into the through-hole 87 of each contact plate portion 82, a screw is inserted into the through-hole 86, the through-hole 105, and a screw hole formed in the lower cover 12 so as to correspond to the through-hole 86 and the through-hole 105, whereby the contact plate portions 82 of the frame 80 and the protruding portions 103 of the supply frame 100 are screwed to the lower cover 12.

As shown in FIG. 5, a screw is inserted into each through-hole 90 of the frame 80 and each screw hole formed in the lower cover 12 so as to correspond to each through-hole 90, whereby the frame 80 is screwed to the lower cover 12.

Further, in a state in which the through-hole 108 of each projecting portion 104 of the supply frame 100 and a screw hole formed in the lower cover 12 so as to correspond to the through-hole 108 are positioned relative to each other, a screw is inserted into the through-hole 108 of each projecting portion 104 and the screw hole of the lower cover 12, whereby the supply frame 100 is screwed to the lower cover 12.

Transmission of Force from Supply Arm 26 to Supply Frame 100

As shown in FIG. 2, when the recording sheet 16 is supplied from the supply tray 20 by the supply roller 25, a frictional force acts between: a lower surface of the uppermost sheet 16 and an upper surface of another sheet disposed right under the uppermost recording sheet 16 or a sheet support surface of the supply tray 20. In this case, the uppermost recording sheet 16 tends to remain without being moved. This causes a resistance against rotation of the supply roller 25, namely, against rotation of the supply roller 25 in a clockwise direction in FIG. 2, so that the supply roller 25 is moved forward. As a result, the pivotable portion 112 of the supply arm 26 pivots in a counterclockwise direction in FIG. 2, so that the pivot shaft 28 is moved upward by an upward force acting thereon. Consequently, the supply frame 100 receives the upward force from the stationary portion 111 that supports the pivot shaft 28, as shown in FIG. 7.

As described above, the stationary portion 111 of the supply arm 26 is fixed by screwing to the vertical plate portion 102 of the supply frame 100. The screwed positions of the supply frame 100 are in the region thereof located inward, in the right-left direction 9, of the protruding portions 103 which are held in contact with the lower surfaces 82A of the contact plate portions 82 of the frame 80. Therefore, the upward force that is applied from the supply arm 26 to the supply frame 100 is a force that causes the central portion of the supply frame 100 in the right-left direction 9 to be moved upward.

Advantageous Effects

In the present embodiment, the supply frame 100 and the frame 80 are coupled to each other. As compared with an arrangement in which the frame 80 and the supply frame 100 are separately attached to the lower cover 12 formed of a resin member with a lower degree of dimensional accuracy, this arrangement ensures good positional accuracy between the supply frame 100 and the frame 80, resulting in good positional accuracy between: the rotation shaft 25A of the supply roller 25 supported by the supply frame 100, namely, the pivot shaft 28 of the supply arm 26 supported by the supply frame 100; and the rotation shaft 60A of the conveyance roller 60 supported by the frame 80. Further, the upward force that acts on the supply frame 100 from the supply roller 25 via the supply arm 26 is received by the lower surfaces 82A of the contact plate portions 82 of the frame 80. The contact plate portions 82 are not easily deformed because of the wall portions 83. It is consequently possible to prevent the frame 80 from being deformed by a force that acts thereon from the supply frame 100. Thus, the recording sheet 16 is prevented from being skewed in the present embodiment.

In the present embodiment, the supply arm 26 is located at an intermediate position of the supply frame 100 in the right-left direction 9, and the frame 80 includes the two contact plate portions 82 located at its opposite end portions in the right-left direction 9. If the frame 80 does not include the wall portions 83, the frame 80 tends to be deformed such that its central portion in the right-left direction 9 is displaced more easily than its opposite end portions in the right-left direction 9. The present embodiment reduces a risk that the central portion of such a frame 80 in the right-left direction 9 receives the upward force that acts on the supply frame 100 from the supply roller 25. Further, the frame 80 is prevented from being deformed due to displacement of the central portion of the supply frame 100 in the right-left direction 9.

In the present embodiment, the supply frame 100 includes the vertical plate portion 102 which is bent downward with respect to the horizontal plate portion 101. This arrangement prevents deformation of the supply frame 100 by the upward force that acts on the central portion of the supply frame 100 in the right-left direction 9 from the supply roller 25 via the supply arm 26.

In the present embodiment, the MFP 10 includes the housing 14 including: the first conveyance path 65 configured to guide the recording sheet 16 such that the recording sheet 16 supplied from the supply roller 25 makes a U-turn, is then conveyed to the conveyance roller 60, and is further conveyed downstream of the conveyance roller 60; and the switchback conveyance path 67 connected to the conveyance path 65 at two positions of the conveyance path 65. Further, the frame 80 includes the two contact plate portions 82 which are spaced apart from each other in the right-left direction 9. Moreover, the frame 80 and the supply frame 100 define the opening 121 between the two contact plate portions 82, and the recording sheet 16 guided by the switchback conveyance path 67 passes through the opening 121. According to the arrangement, the conveyance path 65 and the switchback conveyance path 67 effectuate switchback conveyance of the recording sheet 16. Further, the switchback conveyance path 67 is partly defined, between the two contact plate portions 82 spaced apart from each other in the right-left direction 9, by the front extending portion 84 of the frame 80 and the horizontal plate portion 101 of the supply frame 100. Consequently, the switchback conveyance path 67 is formed without an increase in the size of the MFP 10.

In the present embodiment, a portion of each contact plate portion 82 and the center of the pivot shaft 28 are located at the same position in the front-rear direction 8 perpendicular to the right-left direction 9. In this arrangement, the contact plate portion 82 is located at a position at which the magnitude of a force transmitted from the supply frame 100 to the frame 80 is large, so that the frame 80 is effectively prevented from being deformed.

In the present embodiment, the supply roller 25 is constituted by the two rollers 34, 35 disposed so as to be spaced apart from each other in the right-left direction 9. This arrangement is also effective for preventing the recording sheet 16 from being skewed.

In the MFP10 according to the present embodiment, the recording head 39 is mounted on the carriage 23, the carriage 23 is held by the guide rails 43, 44 such that the carriage 23 reciprocates along the right-left direction 9, and the guide rails 43, 44 are supported by the frame 80. This arrangement ensures positional accuracy between the recording head 39 and the conveyance roller 60, in addition to positional accuracy between the supply roller 25 and the conveyance roller 60. Consequently, an image can be accurately recorded on the recording sheet 16.

According to the present embodiment, the recording sheets 16 can be accurately conveyed in the MFP 10 equipped with the supply roller 25 of a pendulum type.

Modifications

In the illustrated embodiment, the lower surface 82A of each contact plate portion 82 extends along the plane defined by the front-rear direction 8 and the right-left direction 9. The lower surface 82A is not necessarily required to extend along the plane defined by the front-rear direction 8 and the right-left direction 9. It is just required that the lower surface 82A extends along a direction in which the lower surface 82A can effectively receive the force transmitted from the supply frame 100 to the frame 80 via the supply arm 26, the force being generated when the supply roller 25 supplies the recording sheet 16 from the supply tray 20.

In the illustrated embodiment, the MFP 10 includes the switchback conveyance path 67 and is configured to perform image recording on both sides of the recording sheet 16. The MFP 10 may be configured not to include the switchback conveyance path 67 and may perform image recording on only one side of the recording sheet 16.

In the illustrated embodiment, the switchback conveyance path 67 is partially defined by the front extending portion 84 of the frame 80 and the horizontal plate portion 101 of the supply frame 100. The switchback conveyance path 67 is not necessarily required to be defined by the frame 80 and the supply frame 100. In the present embodiment, the switchback conveyance path 67 is configured such that the recording sheet 16 guided by the switchback conveyance path 67 passes through the opening 121 defined by the frame 80 and the supply frame 100. The frame 80 and the supply frame 100 may be constructed so as not to contribute to formation of the switchback conveyance path 67. In the construction, the recording sheet 16 guided by the switchback conveyance path 67 does not contact any of the frame 80 and the supply frame 100.

In the illustrated embodiment, the supply roller 25 is constituted by the two rollers 34, 35 which are spaced apart from each other in the right-left direction 9. The supply roller 25 may be constituted by a single roller.

In the illustrated embodiment, the switchback conveyance path 67 is disposed relative to the conveyance path 65 such that the branch position 36 is located downstream of the recording portion 24 in the conveyance path 65 and the merge position 37 is located upstream of the recording portion 24 in the conveyance path 65. The switchback conveyance path 67 may be otherwise disposed. For instance, the switchback conveyance path 67 may be disposed such that both of the branch position 36 and the merge position 37 are located upstream of the recording portion 24 in the conveyance path 65.

What is claimed is:

1. A sheet conveyor, comprising:

a shaft defining an axis that extends in a first direction;

an arm pivotable about the axis;

a supply roller provided on the arm and configured to supply a sheet;

a first frame formed of metal and supporting the shaft;

a first conveyance roller configured to convey the sheet supplied from the supply roller; and a second frame formed of metal and supporting the first conveyance roller, wherein the second frame includes (a) a contact plate portion shaped like a plate and having a contact surface that is held in contact with the first frame and (b) a wall portion extending from the contact plate portion in a direction intersecting the contact surface, and wherein the second frame is coupled at the contact plate portion thereof to the first frame.

2. The sheet conveyor according to claim 1, wherein the arm is located at an intermediate position of the first frame in the first direction, and wherein the second frame includes two contact plate portions, each as the contact plate portion, which are located at opposite ends of the second frame in the first direction.

3. The sheet conveyor according to claim 1,

Wherein the second frame includes two contact plate portions, each as the contact plate portion, which are located at opposite ends of the second frame in the first direction, and wherein the arm is located between the two contact portions in the first direction.

4. The sheet conveyor according to claim 1, further comprising a housing including a first conveyance path configured to guide the sheet such that the sheet supplied from the supply roller makes a U-turn, is then conveyed to the first conveyance roller, and is further conveyed downstream of the first conveyance roller; and a second conveyance path connected to the first conveyance path at two positions of the first conveyance path, wherein the second frame includes two contact plate portions, each as the contact plate portion, which are spaced apart from each other in the first direction, and an extending portion positioned between the two contact plate portions in the first direction, the extending portion being formed such that an end of the second frame is bent in a direction intersecting the contact surface, and wherein an opening through which the sheet guided by the second conveyance path is defined by the two contact plate portions, the extending portion and the first frame.

5. The sheet conveyor according to claim 4, further comprising a second conveyance roller disposed in the second the conveyance path, wherein the second conveyance path is connected to the first conveyance path at one of the two positions that is located upstream of the first conveyance roller and at the other of the two positions that is located downstream of the first conveyance roller, the second conveyance path being configured to guide the sheet conveyed by the second conveyance roller.

6. The sheet conveyor according to claim 1, wherein the contact plate portion and the shaft are located at the same position in a second direction perpendicular to the first direction.

7. The sheet conveyor according to claim 1, wherein the supply roller is constituted by two rollers disposed so as to be spaced apart from each other in the first direction.

8. A sheet conveyor, comprising:

a shaft defining an axis that extends in a first direction;

an arm pivotable about the axis;

a supply roller provided on the arm and configured to supply a sheet;

a first frame formed of metal and supporting the shaft;

a first conveyance roller configured to convey the sheet supplied from the supply roller; and a second frame formed of metal and supporting the first conveyance roller, wherein the second frame includes two contact plate portions, which are spaced apart from each other in the first direction, each having a contact surface that is held in contact with the first framed and an extending portion positioned between the two contact plate portions in the first direction and formed such that an end of the second frame is bent in a direction intersecting the contact surface, and wherein the second frame is coupled at the contact plate thereof to the first frame.

9. An ink-jet recording apparatus, comprising:

a recording head;

a carriage on which the recording head is mounted;

a guide rail holding the carriage such that the carriage reciprocates along the first direction; and a sheet conveyor, comprising:

a shaft defining an axis that extends in a first direction;

an arm pivotable about the axis;

a supply roller provided on the arm and configured to supply a sheet;

a first frame formed of metal and supporting the shaft;

a first conveyance roller configured to convey the sheet supplied from the supply roller; and a second frame formed of metal and supporting the first conveyance roller, wherein the second frame includes (a) a contact plate portion shaped like a plate and having a contact surface that is held in contact with the first frame and (b) a wall portion extending from the contact plate portion in a direction intersecting the contact surface, and wherein the second frame is coupled at the contact plate portion thereof to the first frame wherein the guide rail is supported by the second frame.

10. A sheet conveyor, comprising:

a shaft defining an axis that extends in a first direction;

an arm pivotable about the axis;

a supply roller provided on the arm and configured to supply a sheet;

a first frame formed of metal and supporting the shaft;

a first conveyance roller configured to convey the sheet supplied from the supply roller; and a second frame formed of metal and supporting the first conveyance roller, wherein the second frame includes (a) a contact plate portion shaped like a plate and having a contact surface that is held in contact with the first frame and (b) a wall portion extending from the contact plate portion in a direction intersecting the contact surface, wherein the second frame is coupled at the contact plate portion thereof to the first frame, wherein the arm is located at an intermediate position of the first frame in the first direction, wherein the second frame includes two contact plate portions, each as the contact plate portion, which are located at opposite ends of the second frame in the first direction, and wherein the first frame is bent in a direction perpendicular to the first direction.

* * * * *